US005513810A

United States Patent [19]

Lin

[11] Patent Number: 5,513,810

[45] Date of Patent: May 7, 1996

[54] THICKNESS ADJUSTER FOR AN ICE SHAVER

[75] Inventor: Yong-Sue Lin, Tainan, Taiwan

[73] Assignee: Shing-Pun Enterprise Co., Ltd., Tainan, Taiwan

[21] Appl. No.: 443,337

[22] Filed: May 17, 1995

[51] Int. Cl.[6] ..... B02C 18/00

[52] U.S. Cl. ..... 241/95; 241/168; 241/DIG. 17

[58] Field of Search ..... 241/95, 101.2, 241/168, 169, 169.1, DIG. 17

[56] References Cited

U.S. PATENT DOCUMENTS

| | | | |
|---|---|---|---|
| D. 304,897 | 12/1989 | Lin | D7/374 |
| D. 337,239 | 7/1993 | Lin | D7/374 |
| 1,077,482 | 11/1913 | Lippincott | 241/DIG. 17 X |
| 3,679,140 | 7/1972 | Kaishita et al. | 241/95 |
| 4,588,136 | 5/1986 | Homma | 241/95 |
| 4,718,610 | 1/1988 | Gallaher | 241/37.5 |
| 4,998,677 | 3/1991 | Gallaher | 241/95 |
| 5,007,591 | 4/1991 | Daniels, Jr. | 241/37.5 |
| 5,402,949 | 4/1995 | Berner et al. | 241/101.2 |

*Primary Examiner*—John Husar

*Attorney, Agent, or Firm*—Morton J. Rosenberg; David I. Klein

[57] ABSTRACT

A thickness adjuster for an ice shaver includes a flat plate to receive an ice block, a movable gear vertically combined with the flat plate to raise it up and lower it down to adjust the height between the bottom of the ice block and a blade so that shaved tiny ice pieces by the blade may be very fine or very rough. The movable gear is combined with a connecting member and then is engaging a transmitting disc gear also engaging a engaing gear portion or a revolvable adjusting disc, the revolvable adjusting disc being rotated to raise up and lower down the falt plate via the transmitting disc gear and the movable gear.

1 Claim, 4 Drawing Sheets

THICKNESS ADJUSTER FOR AN ICE SHAVER

BACKGROUND OF THE INVENTION

This invention concerns a thickness adjuster for an ice shaver, particularly able to adjust thickness of shaved tiny ice pieces off an ice block, in other words, enabling the ice shaver to shave an ice block into various kinds of size, or fine or rough tiny ice pieces.

Conventional ice shavers can only shave a definite size of tiny ice pieces off an ice block, as the height between the bottom of an ice block and a blade is stationary unadjustable to shave different thickness or size of tiny ice pieces.

SUMMARY OF THE INVENTION

This invention is to offer a thickness adjuster for an ice shaver, enabling it to shave tiny ice pieces of different thickness or size according to a person's taste.

A thickness adjuster for an ice shaver in the present invention includes a flat plate to receive the bottom of an ice block placed thereon to be shaved by a blade, a movable gear combined with the flat plate to be raised up or lowered down by rotation of the movable gear threadably combined with a connecting member. The connecting member has a base for receiving a connecting rod portion of a revolvable disc, which has a gear at an end of the connecting rod portion. The gear has ratchet teeth to engage an center toothed hole of a transmitting disc gear engaging the movable gear. So rotation of the revolvable disc can rotate the transmitting gear. So rotation of the revolvable disc can rotate the transmitting gear and the movable gear to raise up or lower down the flat plate, to perform adjusting the thickness of shaved tiny ice pieces by a blade of an ice shaver. And rotation of the revolvable disc is limited by a semi-circular recess of the connecting member and a square projection of the rotating disc stopped by the recess when the revolvable adjusting disc is rotated, limiting the height of the flat plate to be raised up or lowered down.

BRIEF DESCRIPTION DRAWINGS

The invention will be better understood by reference to the accompanying drawings, wherein.

DESCRIPTION OF THE PREFERRED EMBODIMENTS

Figure 1:
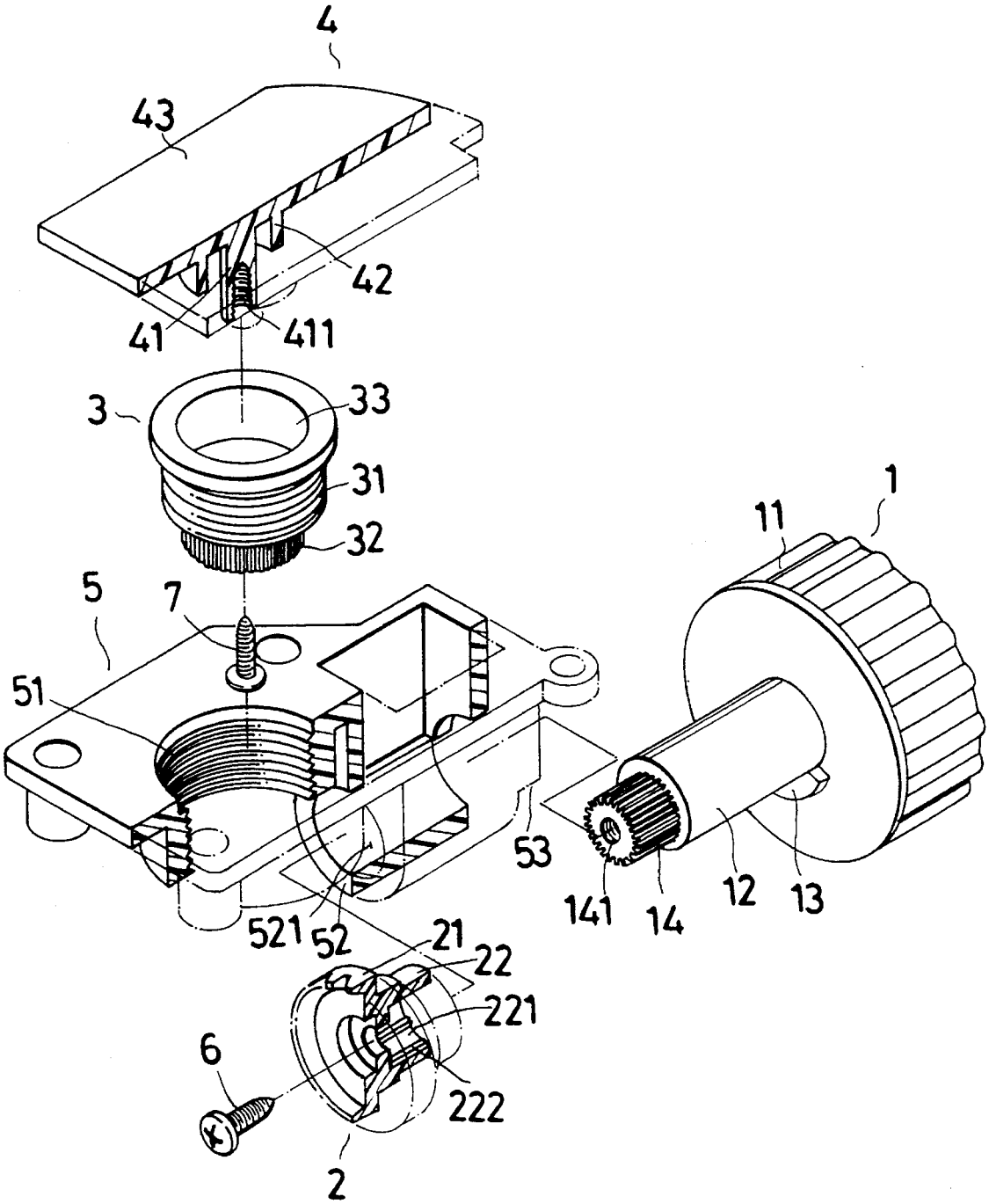
FIG. 1 is an exploded perspective view of a thickness adjuster for an ice shaver in the present invention.

A thickness adjuster for an ice shaver in the present invention, as shown in FIGS. 1 and 3, 4 and 5 includes a revolvable adjusting disc 1, a transmitting disc gear 2, a movable gear 3, a flat plate 4 and a connecting member 5 as main components combined together.

The revolvable adjusting disc 1 has a disc 11, a connecting rod portion 12 extending laterally from a center portion of the disc 11, a projection 13 on an outer surface of the rod portion 12 and abutting on the disc 11, an engaging gear portion 14 having gear teeht formed at an outer end of the rod portion.

The transmitting disc gear 2 has a disc gear 21 at a left end, and a connecting portion 22 at a right end fitting around the connecting rod portion 12 of the adjusting disc 1, a plurality of lengthwise ribs with each two lengthwise ribs 222 as a pair spaced apart equidistantly on the surface of a center hole 221 and engaging comparatively and tightly the teeth of the engaging gear portion 14 of the rotating disc 1.

The movable gear 3 has a male-threaded upper portion 31 and a gear wheel 32 formed in a lower portion and engaging the disc gear 21, and a center opening 33 in the upper portion 31.

The flat plate 4 has a flat plate body 43 for an ice block to be shaved to rest thereon, a tubular post 41 of the small diameter extending down from the bottom surface of the flat plate body 43 and having an inner threaded hole 411, and a large diameter annular short wall 42 extending down from the bottom surface of the flat plate body 43 around the tubular post 41 and fitting in the upper center opening 33 of the movable gear 3.

The connecting member 5 has a vertical threaded hole 51 engaging the male-threaded upper portion 31 of the movable gear 3, a horizontal base 52 having a center hole 521 fitting with the connecting rod portion 12, a left end of the center hole 521 fitting with a smaller diameter connecting portion 22 of the transmitting disc gear 2, and a screw 6 fixing the transmitting disc gear 2 with the revolvable adjusting disc 1.

Figure 2:
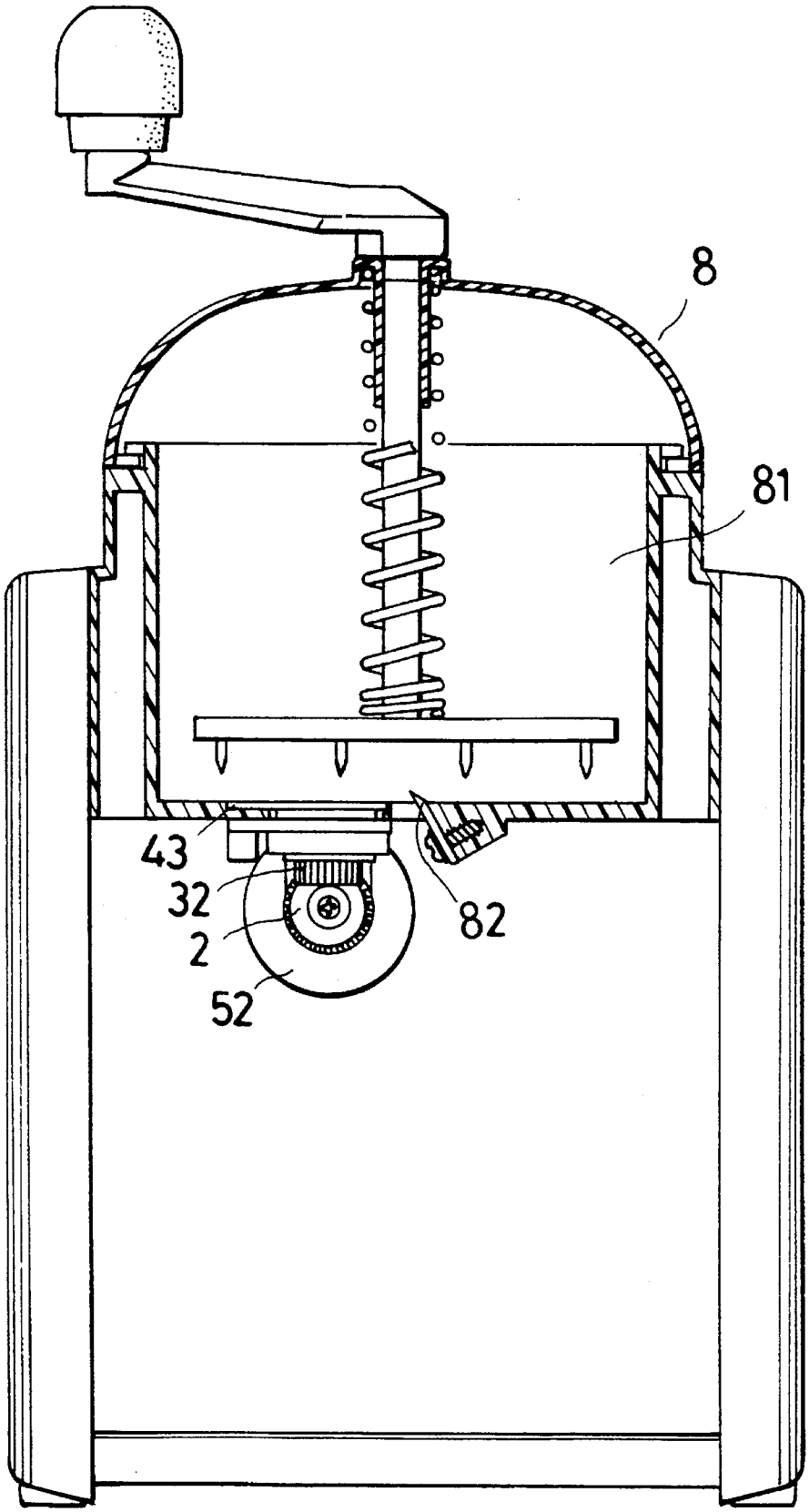
FIG. 2 is a side view of an ice shaver provided with the thickness adjuster for an ice shaver in the present invention.
Figure 3:
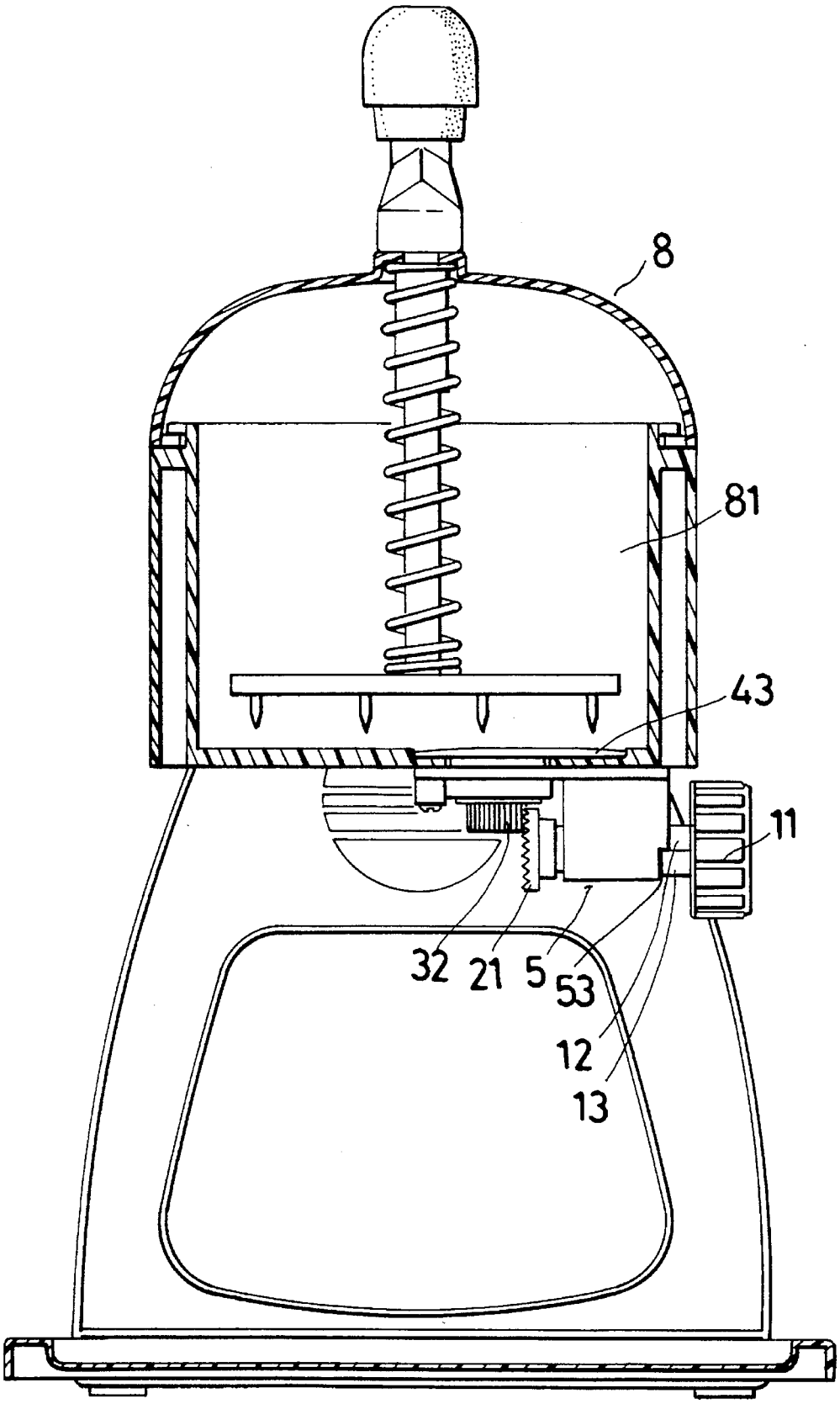
FIG. 3 is a front view of the ice shaver provided with the thickness adjuster for an ice shaver in the present invention.
Figure 4:
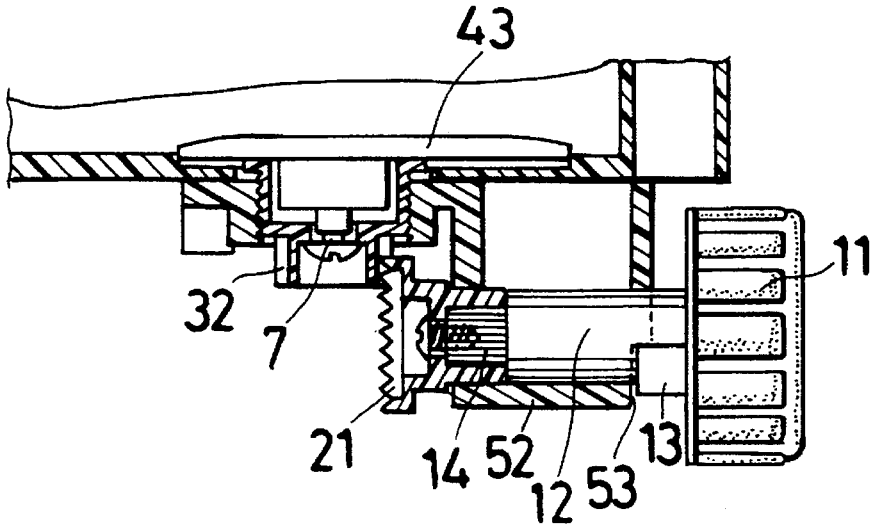
FIG. 4 is a cross-sectional view of the thickness adjuster for an ice shaver in the present invention; and, FIG. 5 is an enlarged side elevational sectional view of the thickness adjuster for an ice shaver in the present invention.
Figure 5:
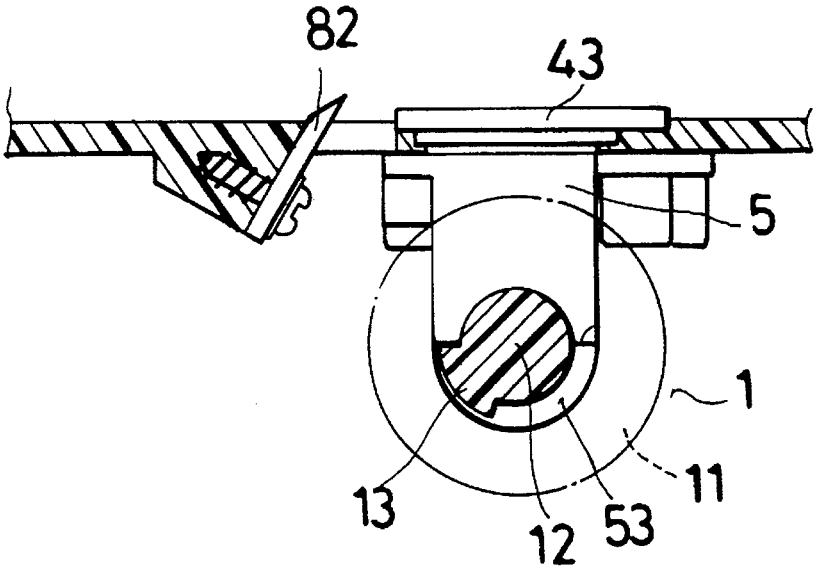

In using, referring to FIGS. 2 and 3, the thickness adjuster assembled together is to be fixed with an ice shaver 8, with the annular projecting wall 42 of the flat plate 4 fitting in the upper center opening 33 of the movable gear 3 and a screw 7 fixing the movable gear 3 and the flat plate 4 together. Then a block of ice is placed in an ice compartment 81 of the ice shaver 8 and on the flat plate 4, and the revolvable adjusting disc 1 is revolved to rotate the transmitting disc gear 3 and then the movable gear 3, as shown in FIGS. 4, and 5, adjusting the height of the flat plate 4 on which the bottom of the ice block is rested. When the flat plate 4 is raised to the highest location, the height difference of the bottom of the ice block and a blade 82 is the least so that shaved tiny ice pieces off the ice block may be the thinnest, i.e. very fine. On the contrary, if the flat plate 4 is lowered to the lowest position, the height difference thereof is the biggest so that shaved tiny ice pieces off may be the thickest, i.e. very rough. In addition, the half-circular recess 53 in a right end of the base 52 of the connecting member 5 stops either side of the projection 13 of the revolvable adjusting disc 1 when the rotating disc 1 is rotated in adjusting, limiting the height of the flat plate 4 raised up and lowered down.

While the preferred embodiments of the invention have been described above, it will be recognized and understood that various modifications may be made therein and the appended claims are intended to cover all such modifications which may fall within the spirit and scope of the invention.

What is claimed is:

1. A thickness adjuster for an ice shaver comprising:

a revolvable adjusting disc having a disc at a right side, a connecting rod portion extending from a center portion of a left side of said disc, a projection located on said rod portion and abutting on said disc, and an engaging gear portion with gear teeth formed at a left end of said rod portion, said gear having a ratchet teeth on an outer circumferential surface;

a transmitting disc gear having a disc gear formed at a left end, a connecting portion formed at a right end to fit around said connecting rod portion of said revolvable adjusting disc and having a smaller diameter than said disc gear, a center hole having its inner surface provided with a plurality of spaced apart lengthwise teeth engaging comparatively tightly said gear teeth of said engaging gear portion of said revolvable adjusting disc;

a movable gear having an upper threaded portion and a lower gear portion engaging said transmitting disc gear, and an opening in said upper threaded portion;

a flat plate having a flat upper portion for receiving the bottom of an ice block to be shaved, a tubular post extending from the bottom of said flat upper portion, a threaded hole provided in said tubular post, a larger diameter short annular wall extending from the bottom of said flat upper portion around said tubular post, said short annular wall fitting around in said opening of said movable gear;

a connecting member having a female threaded hole engaging said upper threaded portion of said movable gear, a horizontal base extending down from beside said portion defining said female threaded hole, said horizontal base having a center hole for said connecting rod portion of said revolvable adjusting disc to fit therein and for said gear of said connecting rod portion to extend out to engage said inner teeth of said center hole of said transmitting disc gear, a screw fixing tightly said transmitting disc gear with said revolvable adjusting disc, and said horizontal base having a semi-circular recess in a right end; and, characterized by said short annular wall of said flat plate fitting in said upper opening of said movable gear, by said screw fixing tightly said movable gear with said flat plate, by said flat plate receiving said bottom of an ice block to be grated, said revolvable adjusting disc being rotated to raise up and lower down said movable gear and said flat plate at the same time by said flat plate being raised up to the highest location so that said bottom of said ice block and a ice blade come to be located the nearest in height to let said ice block shaved off the thinnest, by said flat plate being lowered down to the lowest location so that said bottom of said ice block and said ice blade come to be located the farthest in height to let said ice block shaved off the thickest, by said semi-circular recess of said connecting member stopping one of two sides of said projection of said revolvable adjusting disc to limit rotating angle of said revolvable adjusting disc and thus limiting the highest and the lowest height of said flat plate.

* * * * *